United States Patent [19]

Matsunaga et al.

[11] Patent Number: 4,542,246

[45] Date of Patent: Sep. 17, 1985

[54] ELECTRICAL INSULATING OIL HAVING HIGH OXIDATION STABILITY AND METHOD FOR PRODUCTION THEREOF

[75] Inventors: Atsushi Matsunaga; Sampo Kusayanagi, both of Saitama; Masamitu Takano; Yutaka Kato, both of Akita, all of Japan

[73] Assignee: Nippon Mining Co., Ltd., Tokyo, Japan

[21] Appl. No.: 478,946

[22] Filed: Mar. 25, 1983

[30] Foreign Application Priority Data

| | | | |
|---|---|---|---|
| Mar. 25, 1982 | [JP] | Japan | 57-46216 |
| May 19, 1982 | [JP] | Japan | 57-83304 |
| Jul. 30, 1982 | [JP] | Japan | 57-131908 |
| Mar. 1, 1983 | [JP] | Japan | 58-31761 |

[51] Int. Cl.[4] ..... H01B 3/22

[52] U.S. Cl. ..... 585/6.6; 174/17 LF; 208/14; 252/575; 361/94

[58] Field of Search ..... 174/17 LF; 208/14; 252/575; 361/94; 585/6.6

[56] References Cited

U.S. PATENT DOCUMENTS

| | | | |
|---|---|---|---|
| 3,551,324 | 12/1970 | Lillard | 208/14 |
| 3,586,752 | 6/1971 | Mills et al. | 208/14 |
| 3,759,817 | 9/1973 | Mills et al. | 208/14 |
| 3,904,507 | 9/1975 | Mills | 208/14 |
| 3,932,267 | 1/1976 | Lewis et al. | 585/6.6 |
| 4,069,165 | 1/1978 | Masunaga et al. | 585/6.6 |

*Primary Examiner*—Paul Lieberman
*Assistant Examiner*—Robert A. Wax
*Attorney, Agent, or Firm*—Sughrue, Mion, Zinn, Macpeak, and Seas

[57] ABSTRACT

An electrical insulating oil, comprising:

a base oil selected from the group consisting of a mineral oil, an alkylbenzene, and a mixture of a mineral oil and an alkylbenzene;

a non-basic nitrogen content in an amount of 16 ppm or more; and a basic nitrogen content in an amount of 6% or less based on the weight of the non-basic nitrogen content.

9 Claims, 3 Drawing Figures

ELECTRICAL INSULATING OIL HAVING HIGH OXIDATION STABILITY AND METHOD FOR PRODUCTION THEREOF

FIELD OF THE INVENTION

This invention relates to an electrical insulating oil having high oxidation stability and to a method for the production thereof. More particularly, this invention relates to an electrical insulating oil having a non-basic nitrogen content, a basic nitrogen content, and a sulfide-type sulfur content in concentrations falling within their severally specified ranges in a mineral oil, an alkylbenzene, or a mixture thereof, as a base oil.

BACKGROUND OF THE INVENTION

Electrical insulating oil is used in high-tension electric devices for power transmission such as, for example, oil-immersed transformers, high-tension oil-immersed cables, oil circuit breakers, and oil condensers. While in service in such devices, the electrical insulating oil is required to retain its electrical properties intact and refrain from corroding metallic materials of the devices over long spans of time.

The recent introduction of a technique for the transmission of electric power of extra-high to super-high voltage ranging from 500,000 volts to 1,000,000 volts for the purpose of ensuring economic high-capacity power transmission has given great vigor to the demand for an electrical insulating oil of greater stability to resist oxidation.

As criteria for the evaluation of the oil's stability performance to resist oxidation, JIS C-2320 (Japanese Industrial Standard, concerning "electrical insulating oil") specifies that the total acid number of the oil should not exceed 0.6 mg KOH/g, and the sludge content of the oil should not exceed 0.4 wt% (as measured by the method for testing of oxidation stability specified by JIS C-2101). Non-additive type electrical insulating oils commercially available in Japan are such that their total acid numbers fall in the range of about 0.2 to 0.5 mg KOH/g. Accordingly, these oils still have room for improvement with respect to their ability to resist oxidation.

Criteria available for the evaluation of the quality of an electrical insulating oil are offered by ASTM D-3487, ASTM D-1040, ASTM D-1818, and ASTM D-1819. ASTM D-2440 which covers a testing method for the oxidation stability (similar to the specification of JIS C-2101) specifies that the upper limit of the acid number should not exceed 0.3 mg KOH/g (providing that ASTM D-387 allows addition of an antioxidant in Type II). By reason of electrical properties, electrical insulating oils of the non-additive type are exlusively meeting the demand in the market.

In electrical insulating oils of mineral oil type heretofore known to possess good oxidation stability performance, total nitrogen contents in the oils are limited to within the order of several ppm's (as indicated in Japanese Patent Application (OPI) No. 40799/77 (the term "OPI" as used herein refers to a "published unexamined Japanese patent application")).

U.S. Pat. No. 3,759,817 discloses an invention which requires that the total nitrogen content not exceed 20 ppm and the basic nitrogen limited to within not more than 5 ppm. The idea of improving the oxidation stability of the electrical insulating oil by positively causing the oil to contain therein a non-basic nitrogen content has never been reported or even suggested in literature.

Nitrogen compounds contained in the lubricant fraction separated from a crude oil have been considered as undesirable substance for oxidation stability. Efforts have been made to thoroughly remove the nitrogen compounds as to improve the oxidation stability by treating the fraction such as hydrogenation refining, solvent extraction refining, and solid adsorption refining, occasionally as combined with refining by sulfuric acid treatment.

In the case of crude oil of Middle East origin, for example, the light lubricant fraction separated by distillation from the crude oil has usually a total nitrogen content in the range of about 350 to 450 ppm.

When the lubricant fraction is refined by extraction from such a solvent as furfural, phenol, or N-methyl-2-pyrrolidone, it is divested of sulfur compounds and nitrogen compounds as well as polycyclic aromatic hydrocarbons. When this refining is carried out in combination with hydrogenation refining and solid adsorption refining, there is obtained highly refined mineral oil of notably improved oxidation stability. For all the efforts, the quality of this mineral oil is such that the acid number determined by the test for oxidation stability (JIS C-2101) is barely on the order of 0.2 to 0.3 mg KOH/g. The refining operation described above is not capable of affording mineral oil of better quality having an acid number of the order of 0.05 to 0.1 mg KOH/g. Worse still, this refining operation suffers from higher refining cost and lower yield.

An electrical insulating oil which consists of either an alkylbenzene alone or a mixture of a mineral oil with not less than about 20% by volume of an alkylbenzene as a base oil is highly effective in preventing the drift charging as well as in lowering the pour point but is deficient with respect to its oxidation stability as compared with an electrical insulating oil of the type using mineral oil alone.

SUMMARY OF THE INVENTION

The inventors, after an elaborate study, have found that an electrical insulating oil excelling in ability to resist oxidation is obtained by selectively allowing non-basic nitrogen compounds contained in a crude oil to remain in a certain range of concentration and, meanwhile, causing a basic nitrogen component thereof to be excluded, and further allowing sulfide-type sulfur compounds to remain in conjunction with the non-basic nitrogen content in the finished mineral oil to be separated by distillation from crude oil.

An object of this invention is to provide an electrical insulating oil which, in its non-additive state, exhibits notably high ability to resist oxidation.

Specifically, this invention relates to an electrical insulating oil comprised of, as a base oil, a mineral oil, an alkylbenzene, or a mixture thereof and is characterized by containing at least 16 ppm of nitrogen in the form of non-basic nitrogen compounds, incorporating basic nitrogen compounds in an amount limited to within not more than 6% based on the aforementioned non-basic nitrogen compounds, and further containing not less than 50 ppm of sulfur in the form of sulfide type compounds, and to a method for the manufacture of the electrical insulating oil. The electrical insulating oil of the present invention possesses high ability to resist oxidation and manifests highly advantageous qualities. For example, after oxidation stability test (JIS C-2101)

to ensure resistance to oxidation, the acid number falls to or below 0.10 mg KOH/g.

DETAILED DESCRIPTION OF THE INVENTION

Figure 1:
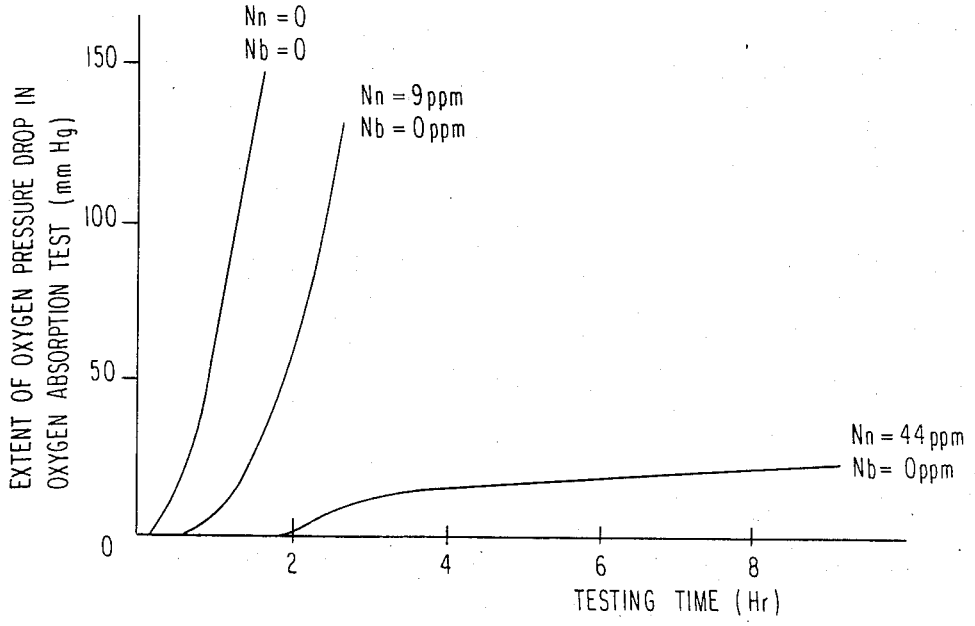
FIG. 1 is a graph showing the relation between oxygen pressure drop and duration time in an oxygen absorption test conducted on electrical insulating oils having an alkylbenzene as a base oil and containing non-basic nitrogen in a varying concentration.

The present invention will now be described in detail herein below. To aid in the comprehension of the following description of invention, the terms used in the specification will be explained.

Total nitrogen content (Nt)

This term refers to the value to be determined by the method specified by JIS K-2609-1980 titled "Method for testing crude oil and petroleum products for nitrogen contents".

Basic nitrogen content (Nb)

This term refers to the value to be determined by the method designated as UOP Method No. 313-70 and titled "Nitrogen Bases in Petroleum Distillates by Color Indicator Titration". This method is based on a procedure which comprises dissolving a given oil sample in glacial acetic acid and titrating the oil with perchloric acid in the glacial acetic acid, with crystal violet as an internal indicator.

Non-basic nitrogen content (Nn)

This term refers to the value to be determined by the aforementioned values of Nt and Nb in accordance with the following formula:

$$Nn = Nt - Nb$$

The term "total nitrogen content (Nt)" as used in the present invention originally means the total content of element nitrogen as in the form of organic nitrogen compounds. Naturally, many kinds of organic nitrogen compounds are present in lubricating oil fraction separated from a crude oil and some of them are removed during the refining and the other are remained after the refining (such as hydrogenation or solvent extraction). For example, quinoline, acridine, indole, pyrrole, carbazole, and derivatives thereof may be cited as typical nitrogen compounds. The basic nitrogen content (Nb) refers to the total content of element nitrogen as in the form of nitrogen compounds possessed of the basicity. The difference between Nt and Nb is referred to as non-basic nitrogen content (Nn).

Total sulfur content (St)

This term refers to the total content of element sulfur which is present in the form of organic sulfur compounds contained in oil.

Sulfide-type sulfur content (Sf)

This term refers to the total content of element sulfur which is present as in the form of sulfur compounds of the structure of sulfide. The sulfide-type sulfur compounds in oil have the fundamental structures shown by Formulae (I) and (II). Some of them naturally occur from the beginning in crude oil and others are formed when thiophene-type sulfur compounds undergo nuclear hydrogenation during the course of hydrogenation refining of oil. There is no need particularly to discriminate them by manner of occurrence.

Formula (I): $R_1—S—R_2$ (wherein $R_1$ and $R_2$ independently denote an alkyl group or aromatic hydrocarbon group having 10 to 30 carbon atoms)

Formula (II)

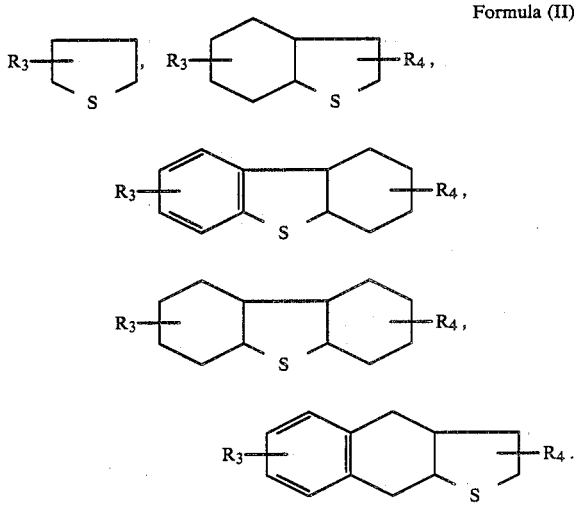

(wherein $R_3$ and $R_4$ independently denote hydrogen or an alkyl group)

The sulfide-type sulfur content can be separated and determined by the method to be described below.

A thin-layer plate for thin layer chromatography (such as, for example, a glass plate having silica gel applied to the surface thereof to a thickness of about 0.25 mm) is sprayed with a hyrochloric acid-acetone-water mixed solution of 0.5 wt% palladium chloride and then dried in draft. On the dry thin-layer plate, a given sample oil is spot deposited in the size of 2 to 4 μl. This spot is developed with a carbon tetrachloride solution to about 10 cm from the position of deposition and then developed with a mixed chloroformmethanol solution (9/1 V/V ratio) further to about 5 cm. By this treatment, the sulfide-type sulfur compounds are separated from hydrocarbons and other organic sulfur compounds and made to form a spot tinted in yellow. By the use of a densitometer (such as, for example, a two-wave chromat-scanner, Model CS-910 made by Shimadzu Seisakusho), the tinted spot is irradiated with a visible ray of 380 nm and determined for absorbance. At the time that the sample oil is tested as described above, a sample of a known sulfide concentration is similarly developed and tested by the same procedure described above. Consequently, the sulfide-type sulfur content (Sf) in the sample oil can be determined.

One kind of base oils consisting of the electrical insulating oil of the present invention is mineral oil (i.e., a fraction separated from a crude oil by distillation). The fraction having a degree of viscosity suitable for an electrical insulating oil, namely, viscosity of the order of 4 to 30 cSt (at 40° C.). When the electrical insulating oil is made of, as a base oil, mineral oil alone, a suitable viscosity thereof is 4 to 20 cSt, preferably 4 to 15 cSt, at 40° C. When it is made of, as a base oil, a mixture of mineral oil and alkylbenzene, the mineral oil is selected to have a viscosity such that the viscosity of the mixture is 4 to 20 cSt at 40° C. Such mineral oil has a boiling point of about 250° C. to about 400° C. at atmospheric pressure. Since the naphthene type crude oil is presently difficult to obtain, the fact that the paraffin type or mixed type crude oil can be preferably used as the starting material for the mineral oil is a highly advantageous feature.

The fraction separated by distillation is refined by such methods as hydrogenation, solvent extraction, dewaxing treatment, and clay adsorption and consequently finished as mineral oil possessed of attributes proper for an insulating oil. Non-basic nitrogen compounds and sulfide-type sulfur compounds are naturally present in the crude oil. Accordingly, due consideration should be given to the proper control of the conditions for the aforementioned refining treatment so that the undesirable components in the eventually produced mineral oil can be removed during the treatment while the required components in the mineral oil are selectively allowed to survive during the refining treatment.

Another kind of base oil of the electrical insulating oil contemplated by the present invention is a straight or branched chain alkylbenzene having a viscosity of 5 to 30 cSt at 40° C. This alkylbenzene is defined to be a mono-, di-, or trialkylbenzene whose side chain alkyl group has a total of not less than nine carbon atoms or a mixture of such alkylbenzenes. Generally, it is produced as a by-product during the synthesis of straight chain (soft) or branched (hard) alkylbenzene as an intermediate for synthetic alkylbenzene sulfonate detergent by causing a more volatile olefin such as, for example, propylene oligomer to react upon benzene or a long chain α-olefin or long chain halogenated normal paraffin to react upon benzene.

For use as the base oil of the insulating oil contemplated by this invention, an alkylbenzene having viscosity (at 40° C.) in the range of 5 to 30 cSt, preferably 7 to 20 cSt, proves to be advantageous. When the alkylbenzene alone is used as the base oil, the viscosity thereof varies depending upon the utility, but it is suitably selected within the range of from 5 to 30 cSt at 40° C. When the mixture of alkylbenzene and mineral oil is used as the base oil, the alkylbenzene is selected to have a viscosity such that the viscosity of the mixture is 4 to 20 cSt at 40° C. In the production of an electrical insulating oil such as transformer oil to be used in transformers for the transmission of power of extra-high to super-high voltage which must be circulated at a high speed so as to be cooled by radiation of heat, use of such an alkylbenzene is effective in notably improving the drift-charge preventing property, corona resistance, and low temperature flowing properties. But, the alkylbenzene is inferior to mineral oil in oxidation stability.

In the electrical insulating oil of the present invention, the non-basic nitrogen content (indicated as Nn) is required to be contained in a concentration of not less than 16 ppm, preferably 20 to 260 ppm, more preferably 25 to 230 ppm, while the basic nitrogen content (indicated as Nb) to be contained in a concentration limited to within not more than 6%, preferably not more than 5%, based on the non-basic nitrogen content. In other words, the total nitrogen content (Nt) should be preponderantly formed of the non-basic nitrogen content and the basic nitrogen content should be limited to as low a concentration as permissible. For the effect of Nn to be thoroughly manifested, the sulfide-type sulfur content (indicated as Sf) is required to be contained in a concentration of not less than 50 ppm, preferably not less than 60 ppm, more preferably 100 ppm to 2,000 ppm.

Table 1 shows data on sample oils made of mineral oil, alkylbenzene, and a mixture thereof as the base oil, containing Sf in varying concentrations in the range of 100 to 3,000 ppm, and containing Nn and Nb in varying concentrations. Data on the oxidation stability of such sample oils as indicated in terms of acid numbers obtained subsequently to the test for oxidation stability prescribed by JIS C-2101 and of induction periods determined by the test of oxygen absorption. The term "induction period" as used herein refers to the duration from the time that a given sample oil is placed under an atmosphere of pure oxygen at a pressure of 1.5 atmospheres in the presence of a copper wire catalyst and left standing at 145° C. until the time that the oxygen pressure falls by 30 mm Hg.

TABLE 1

| Type of Base Oil | Nn (ppm) | Nb (ppm) | Acid Number (JIS C-2101) (mg KOH/g) | Induction Period (minute) |
|---|---|---|---|---|
| Mineral oil | 1 | 0.2 | 0.30 | 80 |
| " | 16 | 0.7 | 0.18 | 240 |
| " | 40 | 1.0 | 0.18 | 350 |
| " | 46 | 0.7 | 0.13 | 440 |
| " | 130 | 1.0 | 0.10 | 520 |
| " | 260 | 1.0 | 0.12 | 450 |
| " | 18 | 2.0 | 0.30 | 90 |
| " | 100 | 10.0 | 0.30 | 120 |
| Alkylbenzene | 0 | 0 | 6.50 | 40 |
| " | 44 | 0.7 | 0.08 | >800 |
| Alkylbenzene/ mineral oil | 25 | 0.7 | 0.04 | >800 |

Separately from the test of Table 1, when Nn was varied up to 540 ppm, the ability of the oil to resist oxidation tended to decline as the Nn content exceeded 260 ppm and the oil showed sign of sludge formation. It is, therefore, desirable to fix the upper limit of the Nn content at 260 ppm.

Although the Nb content should be lowered as closely to zero as permissible, the presence of Nb in an amount of not more than 6% based on Nn cannot impair the ability of the oil to resist oxidation. When the Nn content is about 30 ppm, for example, the Nb content should be limited to or below 2 ppm, preferably 1 ppm. The results of a test conducted to determine the effects of Nn concentration in alkylbenzene upon stability to resist oxidation indicated in terms of oxygen absorption are shown in FIG. 1. From the graph, the effect of Nn is noted to be conspicuous. Nn and Nb in synthetic alkylbenzene as is are respectively zero, and the oxidation stability (induction period) of such synthetic alkylbenzene is merely 60 minutes or less. But, the oxidation stability markedly increases as Nn increases.

In order for the non-basic nitrogen content to manifest its effect advantageously in enhancing the oxidation stability of the lubricating, it is necessary that the sulfide-type sulfur compounds be present in a total amount of not less than 50 ppm, preferably not less than 60 ppm, more preferably 100 ppm to 2,000 ppm, as Sf. Sulfide-type sulfur compounds are originally present in crude oil. They are also generated from thiophene type compounds during the hydrogenation refining of mineral oil as a starting material. When the hydrogenation refining is carried out severely, sulfide-type sulfur compounds are liable to be desulfurized and removed sharply from the oil during the treatment. Thus, due consideration must be paid to proper control of the conditions of hydrogenation refining. But, other type sulfurs, such as thiophene or dibenzothiophene, are allowed to remove much more. The test was conducted to see synergistic effect between Nn and Sf. The lubricant fraction separated by distillation from the crude oil of Kuwait origin was refined to obtain sample oils containing Nb in a concentration of not more than 1 ppm and Nn and Sf in varying concentrations by the addition of non-basic nitrogen compounds and sulfide compounds. The sample oils were tested for oxidation stability by the method of the oxygen abosrption test. The results are as shown in Table 2. As will be shown in Table 2, non-basic nitrogen compounds make manifest the effects in conjunction with sulfide-type sulfur compounds.

TABLE 2

| Nn | Sf (ppm) | | |
|---|---|---|---|
| (ppm) | 10 | 50 | 200 |
| 6 | 50 minutes | 70 minutes | 55 minutes |
| 20 | 55 | 330 | 300 |
| 100 | 58 | >700 | 650 |

Figure 2:
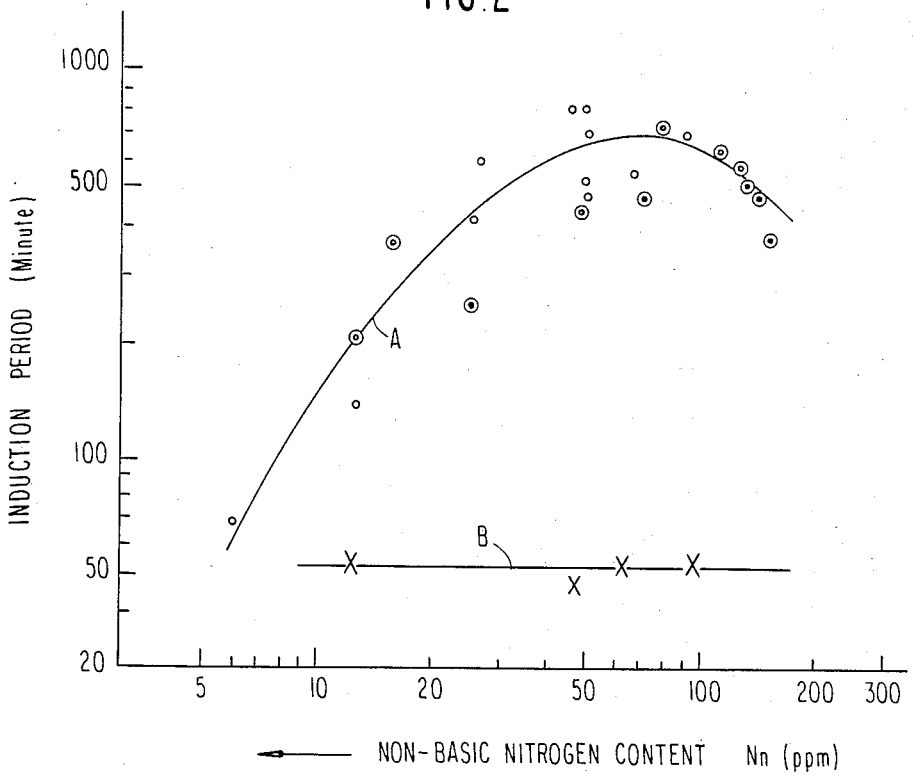
FIG. 2 is a graph showing the effect of non-basic nitrogen content upon induction period; in the graph, curve A represents a case of this invention wherein the sulfide-type sulfur content is present in the range of 50 to 2,000 ppm and curve B a case of the comparison wherein the same content is present in a proportion of not more than 10 ppm.

An electrical insulating oil of mineral oil type containing 28 ppm of Nn and absolutely zero in Nb was obtained by subjecting the starting lubricating fraction separated from crude oil to hydrogenation refining until the ratio of desulfurization rose beyond 90% and subjecting the resulting refined oil further to clay-adsorption refining. The Sf content in the resulting oil fell substantially to zero. This insulating oil showed an induction period of only 45 minutes in the absorption of oxygen. The induction period of this insulating oil was increased to 450 minutes when its Sf content was raised to 100 ppm by addition of dodecylsulfide. In the case of liquid paraffin oil, which is of severely refined mineral oil type, having an induction period of 35 minutes, mere addition of 100 ppm as Sf of dodecylsulfide only increased the induction period of the paraffin to 50 minutes. When a non-basic nitrogen compound concentrate separated from mineral oil was further added to the paraffin oil up to 25 ppm of Nn, the induction period incredibly rose to 600 minutes. FIG. 2 gives results which indicate the synergistic effects of Nn and Sf in the improvement of the ability of insulating oil to resist oxidation. In the graph, the marks • indicate the values of mineral oil containing Sf in concentrations of 50 to 500 ppm, the marks ⊙ the value of mineral oil containing Sf in concentrations of 800 to 2,000 ppm, and the marks × the values of mineral oil containing Sf in concentrations of 0 to about 10 ppm. Curve A collectively represents the results obtained of mineral oil containing Sf in concentrations of not less than 50 ppm and Curve B collectively represents the results obtained of mineral oil containing substantially no Sf. Benzothiophene and dibenzothiophene type compounds neither impair nor enhance the improvement of the ability to resist oxidation.

The method by which the electrical insulating oil of the present invention is produced will now be described. For the production of an electrical insulating oil which contains not less than 16 ppm of a non-basic nitrogen content (Nn), not more than 6%, based on Nn, of a basic nitrogen content (Nb), and not less than 50 ppm of a sulfide-type sulfur content (Sf), there are adopted two methods in substance, i.e., done being a base oil mixing method and another being an Nn concentrate addition method. It is also possible to use a combination of these two methods.

Base oil mixing method

Figure 3:
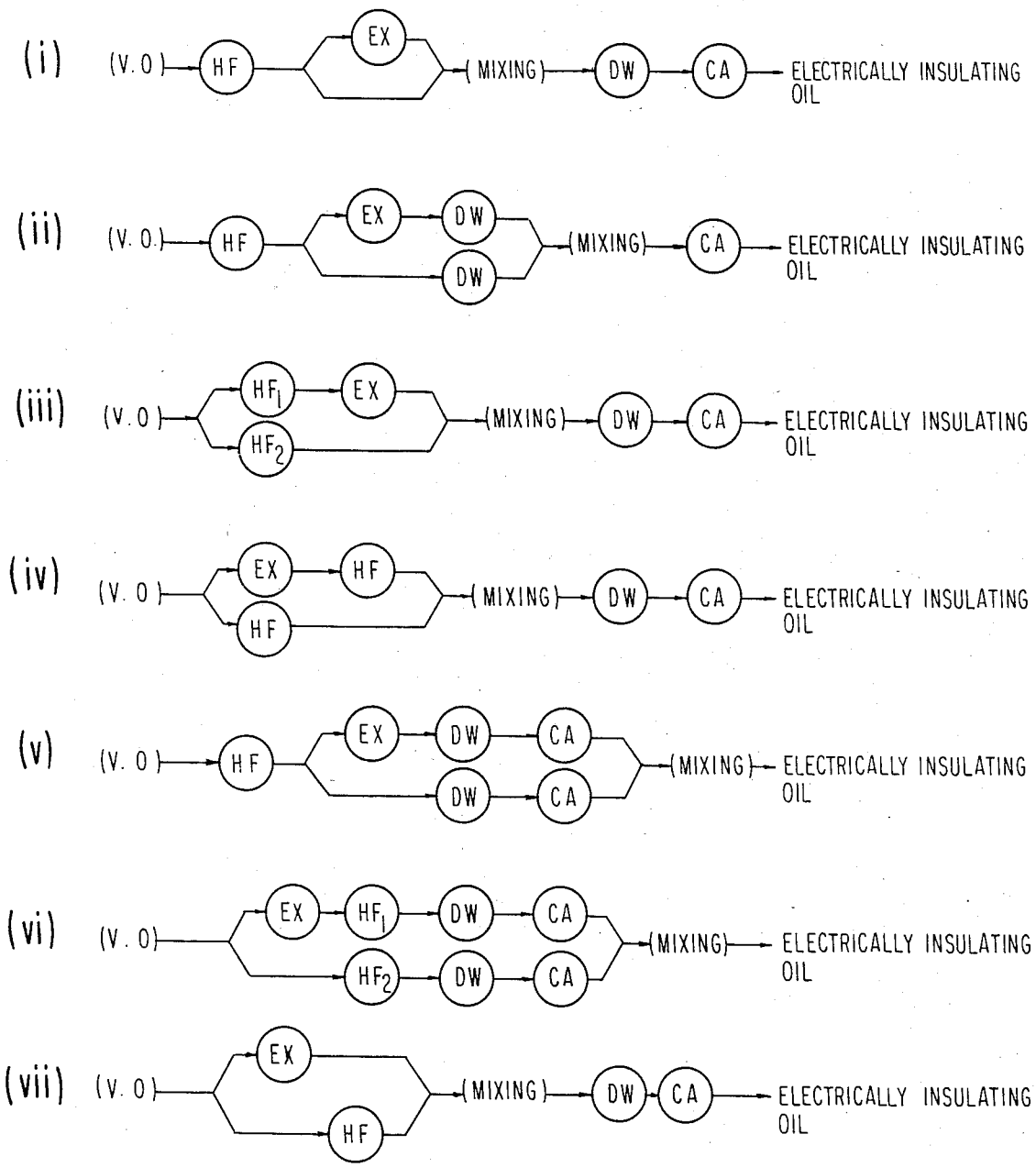
FIG. 3 is a flow diagram illustrating the procedure to produce an electrical insulating oil of this invention, starting from lubricating oil fraction (V·O) separated from a crude oil by vacuum distillation.

FIG. 3 represents a flow diagram of a typical base oil mixing method. This method is adopted for the production of an electrical insulating oil which is comprised of mineral oil or a mixture of mineral oil with an alkylbenzene as the base oil. In the diagram, V·O stands for mineral oil fraction separated from crude oil, whose viscosity is in the range of from 4 to 30 cSt at 40° C., as the starting material, HF for hydrogenation refining, EX for solvent-extraction refining, DW for solvent-dewaxing refining, and CA for adsorption refining. All these methods of refining are known in the art. The control of the Nn, Nb, and Sf contents for the manufacture of the electrical insulating oil of this invention necessitates mixing two or more base oils which are obtained by different methods of refining or under different conditions.

One of the two base oils indicated in each of the flows (i) through (vii) of FIG. 3 has been obtained without undergoing the EX treatment. The CA treatment must be given either before or after the mixing of the two base oils. The base oil obtained by the treatment indicated on the upper side of each flow is a highly refined oil (HRO) by solvent treatment and the base oil obtained by the treatment indicated on the lower side of each flow is a lowly refined oil (LRO) obtained without undergoing the solvent refining treatment. LRO contains more aromatic hydrocarbons than HRO, particularly polycyclic aromatic hydrocarbons, and nitrogen compounds richly as compared with HRO. The mixing ratio between LRO and HRO may be suitably selected in the range of 95:1 to 5:95 (by volume), depending on the compositions of LRO and HRO and the quality, composition, and cost of the electrical insulating oil to be produced. Since LRO contains more aromatic hydrocarbons in addition to Nn and Sf than HRO, the mixing proportion of LRO can be less than that of HRO, whereby insulating oils which can fully meet the requirements of the invention can be obtained. In the flow (iii), (iv), or (vi) of FIG. 3, the conditions involved in the HF treatment may be different. In the CA treatment, clay is generally used and the conditions of the treatment are selected so as to ensure thorough adsorption and removal of basic nitrogen compounds. The DW treatment is adopted for the purpose of lowering the pour point of the mineral oil and has no special significance with respect to the adjustment of Nn, Nb, and Sf contents. In the EX treatment, a solvent having affinity for aromatic compounds is used. Examples of the solvent are furfural, phenol, and N-methyl-2-pyrrolidone. In the HF treatment, there is used a known hydrogenation catalyst capable of desulfurizing and denitrogenating mineral oil under high hydrogen pressure, namely, a known hydrogenation catalyst which has oxides and/or sulfides of Ni, Ti, Mo, Co, and W as an active metal deposited on a support made of alumina, silica, or alumina-silica.

The production of an electrical insulating oil by the procedure of the flow (i) of FIG. 3 will now be described. The light or light to medium fraction of average volatility (V·O) separated by distillation from the crude oil of Middle East origin, for example, has a total sulfur content (St) in the range of 1.2 to 2.4 wt%, an Nt content in the range of 250 to 500 ppm, and an Nb content in the range of 100 to 200 ppm approximately. When this fraction is refined by the HF treatment under the condition of ratio of desulfurization in the range of 50 to 80%, there is obtained LRO which has an St content in the range of 0.5 to 1.2 wt%, an Sf content approximately in the range of 2,000 to 5,000 ppm, an Nt content approximately in the range of 150 to 400 ppm, and an Nb content approximately in the range of 60 to 120 ppm. When part of this LRO is further subjected to the EX treatment, there can be attained desulfurization of 50 to 80% denitrogenation exceeding about 70%. The HRO consequently obtained has an St content approximately in the range of 0.1 to 0.6 wt%, an Sf content approximately in the range of 500 to 3,000 ppm, an Nt content approximately in the range of 30 to 70 ppm, and an Nb content approximately in the range of 5 to 60 ppm. When LRO and HRO are mixed in proper proportions and the resultant mixture is subjected to the CA treatment, the Nb content is preferentially removed and the Nn and Sf contents are left intact, to afford the electrical insulating oil of the present invention.

A more highly refined insulating oil can be obtained by rendering the conditions of the aforementioned treatment of HF or EX severer. In this case, however, due precautions should be exercised to avoid allowing the ratio of desulfurization in the HF treatment to reach or exceed 90%. Otherwise, the sulfide-type sulfur content will be present in an excessively low concentration in the produced insulating oil.

In the flow (iii) of FIG. 3, the treatment of HF is carried out under different conditions; i.e., severe conditions for the production of HRO and mild conditions for the production of LRO. In this case, the mixing proportion of HRO is in the range of 60 to 90 vol% to afford an electrical insulating oil of low sulfur content. Optionally, liquid paraffin or an alkylbenzene may be used as HRO. In the flow (vii) of FIG. 3, LRO containing an Nn content approximately in the range of 20 to 50 ppm and divested substantially completely of Sf content is obtained by the HF treatment conducted under such severe conditions so as to give a desulfurization ratio exceeding 90%, and this LRO is mixed with 1 to 10 vol% of HRO obtained as an Sf source by the EX treatment, and the resultant mixture is refined by the CA treatment for removal of the Nb component.

The selective survival of the Nn content in the produced electrical insulating oil as contemplated by the present invention has never been attained by a conventional method which carries out the HF, EX, DW, and CA treatments under severally severe conditions for the purpose of divesting the mineral oil of sulfur, nitrogen, wax, and polycyclic aromatic compounds to a great extent.

Non-basic nitrogen concentrate addition method:

Now, the production of an electrical insulating oil by the non-basic nitrogen concentrate addition method (Nn conc. addition method) will be described below. The Nn concentrate is obtained by separating the non-basic nitrogen compounds (Nn compounds) in a concentrated form from the aforementioned V·O oil or the hydrogenated refined mineral oil produced by subjecting the V·O oil to HF treatment.

For selective concentration and separation of the Nn compounds from the aforementioned V·O or hydrogenated refined oil as the starting material, there is adopted a procedure of comprising the steps of treating this mineral oil with an adsorbent such as clay which is capable of adsorbing the basic nitrogen compounds (Nb compounds), causing the resultant oil to come into contact with silica gel thereby enabling the Nn compounds to be adsorbed on the silica gel, and then subjecting the silica gel which has adsorbed the Nn compounds to elution with a methanol/methylene chloride solvent thereby effecting separation of the Nn compounds from the silica gel. The concentrated Nn compounds may be obtained by subjecting the eluted solution to evaporative removal of the solvent under a current of nitrogen gas. Thus, a viscous liquid, Nn conc., is obtained.

The Nn conc. obtained as described above contains substantially no Nb compounds. Instead it contains Nn compounds in a concentrated form. It also contains sulfide-type sulfur compounds in an amount sufficient for the purpose of this invention. A cation-exchange resin is an effective substitute for the aforementioned clay and alumina or fluorisil an effective substitute for silica fel in the treatment. When an unrefined fraction of viscosity of 11.7 cSt (at 40° C.) obtained from the crude oil of Kuwait origin, for example, is treated by the procedure mentioned above, there is obtained an Nn concentrate having absolutely no Nb content and containing 1.22 wt% of Nn, 6.57 wt% of St, and 4.0 wt% of Sf. When the HF oil (desulfurization ratio 70%) obtained by subjecting the vacuum fraction to hydrogenation refining is treated by the same procedure, there is obtained an Nn concentrate having absolutely no Nb content and containing 2.30 wt% of Nn, 4.6 wt% of St, and 2.5 wt% of Sf.

These Nn concentrates share an ability to enhance the oxidation stability of an electrical insulating oil without any significant problem. The Nn concentrates similarly separated from the crude oil of Arabian Light, the crude oil of Basra origin, etc., have an equal ability. The amount of the Nn concentrate to be added, though variable with the nature of the improvement aimed at, preferably exceeds about 14 ppm, preferably 16 ppm, more preferably 20 ppm, as Nn. The addition of the Nn concentrate proves to be particularly effective for highly refined mineral base oils, alkylbenzenes, alkylnaphthalenes, and mixed oils formed of these hydrocarbon oils. Ordinary electrical insulating oils available in the market are highly refined and contain Nt in amounts about or below several ppm's. Thus, the addition of the aforementioned Nn concentrates to these insulating oils is advantageous.

The present invention will now be described more specifically below with reference to working examples and comparative experiments. However, the scope of the invention is not limited to these examples.

EXAMPLE 1

Arabian Light crude oil was distilled under atmospheric pressure. The residual oil was distilled under a vacuum to separate a vacuum-distillation fraction V·O (having a sulfur content of 2.08 wt% and containing 425 ppm of Nt). The V·O was refined by the procedure of Flow (ii) of FIG. 3 to obtain HRO (A), HRO (B), and LRO. The conditions of the individual steps of treatment were fixed as follows.

HF step: Hydrogen pressure 35 kg/cm$^2$ (gauge), temperature 330° C., LHSV 1.5 hr$^{-1}$, and catalyst Ketjenfine TN-4

EX step: (Conditions A): Solvent ratio of furfural to oil is 150% and extraction temperature is 50° C. (Conditions B): Solvent ratio of furfural to oil is 200% and extraction temperature is 70° C.

DW step: Mixed solvent (methyl ethyl ketone/toluene: 1/1) to oil is 260% and temperature is −40° C.

(Note) For the production of LRO, the same conditions used with the HF step and DW step were adopted.

The refined base oils were mixed. The mixed base oil was subjected to the CA treatment under the following conditions, to produce electrical insulating oils, No. 1 through No. 5, conforming to the present invention.

CA step: Activated clay is 1.5 wt% (based on the oil), temperature is 60° C., and contact time is 20 minutes Table 3 shows the properties of the electrical insulating oils (No. 1 through No. 5) and those of an electrical insulating oil of Referential Experiment (No. 6) and those of commercially available electrical insulating oils, A and B.

TABLE 4-continued

| | Liquid Paraffin | Mineral Oil A | Mineral Oil B | Alkylbenzene | Mineral Oil C |
|---|---|---|---|---|---|
| Non-basic nitrogen content, ppm | 0 | 1 | 0 | 0 | 67 |
| Stability to resist oxidation (JIS C-2101) | | | | | |
| Total acid number (mg KOH/g) | 9.50 | 0.32 | 0.35 | 5.77 | 2.10 |
| Induction period (minute) | 35 | 84 | 71 | 40 | 58 |

TABLE 3

| | Sample Oil | | | | | | | |
|---|---|---|---|---|---|---|---|---|
| | No. 1 (Ex.) | No. 2 (Ex.) | No. 3 (Ex.) | No. 4 (Ex.) | No. 5 (Ex.) | No. 6 (Ref. Ex.) | Commercial Product A | Commercial Product B |
| Mixing ratio (by volume) | | | | | | | | |
| HRO (A) | 80 | 70 | — | — | 20 | — | (Mineral | (Mineral |
| HRO (B) | — | — | 90 | 95 | 40 | 95 | oil) | oil) |
| LRO | 20 | 30 | 10 | 5 | 40 | 5 | | |
| Viscosity, cSt at 40° C. | 8.730 | 8.750 | 8.680 | 8.650 | 8.765 | 8.680 | 7.125 | 11.72 |
| Total sulfur content, wt % | 0.39 | 0.45 | 0.24 | 0.21 | 0.47 | 0.24 | 0.05 | 0.54 |
| Sulfide-type sulfur content, ppm | 720 | 880 | 290 | 250 | 920 | 260 | 80 | 3,000 |
| Nt, ppm | 44 | 73 | 23 | 17 | 111 | 21 | 8 | 5 |
| Nb, ppm | 2.0 | 1.9 | 0.8 | 0.7 | 2.0 | 1.8 | 0.4 | 3.8 |
| Nn, ppm | 42.0 | 71.1 | 22.2 | 16.3 | 109.0 | 19.2 | 7.6 | 1.2 |
| Nn/Nn × 100, % | 4.5 | 2.6 | 3.6 | 4.3 | 1.8 | 9.4 | 5.3 | 31.6 |
| Stability to resist oxidation (JIS C-2101) | | | | | | | | |
| Total acid number, mg KOH/g | 0.13 | 0.07 | 0.08 | 0.18 | 0.06 | 0.24 | 0.23 | 0.26 |
| Sludge, wt % | 0.10 | 0.10 | 0.08 | 0.10 | 0.06 | 0.14 | 0.14 | 0.15 |
| Thermal stability (Note 1) | | | | | | | | |
| Dielectric tangent, % | 0.149 | 0.115 | 0.051 | 0.380 | 0.220 | 0.420 | 3.680 | 0.530 |
| Volume resistivity, Ω · cm | $3.1 \times 10^{13}$ | $2.3 \times 10^{13}$ | $4.2 \times 10^{13}$ | $1.5 \times 10^{13}$ | $3.0 \times 10^{13}$ | $1.2 \times 10^{13}$ | $3.0 \times 10^{12}$ ↓ | $8.0 \times 10^{12}$ |
| Corrosion on copper plate (JIS C-2101) | None | None | None | None | None | None | None | None |

(Note 1)
This property was determined by placing 50 cc of a given oil in a glass container, allowing the oil to stand under open air at 130° C. for 48 hours, and measuring the indicated physical attributes after the standing.
(Note 2)
For the sample oil, No. 6, the amount of clay used in the CA step was fixed at 0.5 wt % based on the oil. The other conditions were as indicated above.

EXAMPLE 2

A liquid paraffin, mineral oils A, B and C, and an alkylbenzene having the physical properties indicated in Table 4 were used as base oils. By adding to these base oils a non-basic nitrogen concentrate (Nn conc.) obtained by separation from mineral oil, there were obtained electrical insulating oils.

TABLE 4

| | Liquid Paraffin | Mineral Oil A | Mineral Oil B | Alkylbenzene | Mineral Oil C |
|---|---|---|---|---|---|
| Specific gravity | 0.830 | 0.8558 | 0.8698 | 0.871 | 0.8617 |
| Viscosity, cSt at 40°C. | 7.34 | 8.58 | 8.70 | 27.35 | 7.562 |
| Total sulfur content, wt % | 0.001 ↓ | 0.24 | 0.25 | 0.005 | 0.04 |
| Sulfide-type sulfur content, ppm | 10 ↓ | 1,300 | 1,500 | 0 | 10 ↓ |
| Totan nitrogen content, ppm | 1 ↓ | 2 | 1 | 1 ↓ | 67 |

The aforementioned mineral oils A, B and C were prepared by subjecting the fraction V·O (viscosity 11.7 cSt at 40° C.) separated by distillation from the crude oil of Kuwait origin to the procedures of the following flows, respectively. The conditions for $HF_2$ were severer than those for $HF_1$.

V·O→$HF_1$→EX→DW→CC→Mineral Oil A

V·O→EX→AW→Mineral Oil B

V·O→$HF_2$→CC→Mineral Oil C

AW means sulfuric acid washing refining.

The Nn concentrate was separated by treating the aforementioned V·O under the following conditions. It had 6.57 wt% of total sulfur content, 4.0 wt% of sulfide-type sulfur content, 1.22 wt% of total nitrogen content, 1.22 wt% of non-basic nitrogen content, and substantially no basic nitrogen compound.

The separation of the Nn concentrate was effected by keeping the aforementioned V·O in contact with 5.0 wt%, based on the V·O, of activated clay (roasted at 140° C. for 4 hours) at 45° C. for 1 hour, then separating the oil from the clay by filtration, percholating the oil filtrate through a glass column packed with silica gel (Wako Gel C-100), washing the silica gel adsorbent bed with pentane, then washing it with a methylene chloride/pentane mixed solution, eluting the Nn compounds from the adsorbent with a methanol/methylene chloride (mixing ratio 15/85 V/V) mixed solution, and evaporating the solvent from the elute under a current of nitrogen gas to afford the Nn concentrate. Required adjustment of Nn and Sf was effected by adding this Nn concentrate or by mixing base oils suitably. The properties of the resultant sample oils were as shown in Table 5.

Since Sample Oil 7 had an excessively low Nn content and since Sample Oil 10 and Sample Oil 12 which had ample Nn contents of 32 ppm and 45 ppm respectively had substantialy no sulfide-sulfur content (Sf), they all showed poor ability to resist oxidation. Sample Oils 8, 11, and 13 showed notably improved levels of ability to resist oxidation, because they had sufficient amount of the components needed to exceed the lower limits.

TABLE 5

| | Sample Oil 7* | Sample Oil 8** | Sample Oil 9** | Sample Oil 10* | Sample Oil 11** | Sample Oil 12* | Sample Oil 13** | Sample Oil 14** | Sample Oil 15** |
|---|---|---|---|---|---|---|---|---|---|
| Base oil (vol %) | | | | | | | | | |
| Liquid paraffin oil | 100 | 100 | | | | 25 | 25 | | 10 |
| Mineral oil A | | | 100 | | | | | 65 | |
| Mineral oil B | | | | | | | | | 15 |
| Mineral oil C | | | | 50 | 50 | 75 | 75 | 35 | 75 |
| Alkylbenzene | | | | 50 | 50 | | | | |
| Adjustment of Nn and Sf | | | | | | | | | |
| Nn conc. addition | o | o | o | | o | | o | | |
| Base oil mixing | | | | o | o | o | o | o | o |
| Compositions after addition or mixing | | | | | | | | | |
| Total sulfur (St), wt % | 0.0067 | 0.013 | 0.28 | 0.020 | 0.027 | 0.029 | 0.043 | 0.21 | 0.065 |
| Sulfide-type sulfur (Sf), ppm | 30 | 60 | 1,300 | 10 ↓ | 55 | 10 ↓ | 65 | 850 | 230 |
| Non-basic nitrogen (Nn), ppm | 12 | 25 | 110 | 32 | 44 | 45 | 100 | 24 | 45 |
| Basic nitrogen (Nb), ppm | 0 | 0 | 2 | 1 ↓ | 1 ↓ | 3 | 3 | 2 | 3 |
| Stability to resist oxidation (JIS C-2101) | | | | | | | | | |
| Total acid number (mg KOH/g) | 0.36 | 0.07 | 0.10 | 2.20 | 0.08 | 6.50 | 0.05 | — | 0.04 |
| Induction period (minute) | 130 | 680 | 520 | 40 | 800 ↑ | 50 | 800 ↑ | 420 | 800 ↑ |

Note:
*Sample oil not conforming to this invention.
**Sample oil conforming to this invention.

While the invention has been described in detail and with reference to specific embodiments thereof, it will be apparent to one skilled in the art that various changes and modifications can be made therein without departing from the spirit and scope thereof.

What is claimed is:

1. An oxidation stability-improving agent for an electrial insulating oil comprising a concentrate separated from mineral oil and containing as main components: non-basic nitrogen compounds and sulfide-type sulfur compounds, and substantially not containing basic nitrogen compounds.

2. An agent as claimed in claim 1, wherein said mineral oil is a lubricating fraction of a crude oil obtained by hydrogenation refining of said fraction under a mild condition.

3. An agent as claimed in claim 1, wherein said agent is obtained by the process comprising (a) subjecting a mineral oil to clay-adsorption refining to remove therefrom basic nitrogen compounds; (b) subjecting the resulting oil of step (a) to a percolation treatment by passing it through a layer comprising at least one member of the group consisting of solid silica gel, alumina and fluorisil; (c) elution treating said layer with a polar organic solvent; and (d) distilling off the solvent in the eluate under an inert gas atmosphere.

4. An agent as claimed in claim 1, wherein said agent has a non-basic nitrogen content of 1 to 4 wt%, a sulfide-type sulphur content of 2 to 5 wt%, and a basic nitrogen content of 5 ppm or less.

5. A method for improving the oxygen stability of an electrical insulating oil, comprising adding (a) an oxygen stability-improving agent for an electrical insulating oil comprising a concentrate separated from a mineral oil and containing as main components: non-basic nitrogen compounds and sulfide-type sulfur compounds, and substantially not containing basic nitrogen compounds; to (b) a member selected from the group consisting of a refined mineral oil having a viscosity of 4 to 30 cSt at 40° C., an alkylbenzene, and a mixed oil of a refined mineral oil having a viscosity of 4 to 30 cSt at 40° C. and an alkylbenzene, to thereby increase the non-basic nitrogen content and the sulfide-type sulfur content in the resulting oil and thus maintain (i) the non-basic nitrogen content in the resulting oil at 16 to 260 ppm, (ii) the sulfide-type sulfur content in the resulting oil at 50 to 2,000 ppm, and (iii) the basic nitrogen content in the resulting oil at 6% or less based on the non-basic nitrogen content.

6. A method as claimed in claim 5, wherein the resulting oil is maintained such that the non-basic nitrogen content is 25 to 230 ppm, the sulfide-type sulfur content is 60 to 2000 ppm, and that the basic nitrogen content is 6% or less based on the non-basic nitrogen content but does not exceed 3 ppm.

7. A method as claimed in claim 6, wherein the resulting oil is maintained such that then non-basic nitrogen content is 25 to 100 ppm, the sulfide-type sulfur content is 100 to 1000 ppm, and the basic nitrogen content is 6% or less based on the non-basic nitrogen content but does not exceed 3 ppm.

8. A method as claimed in claim 5, wherein said refined mineral oil, alkylbenzene, mixed oil, or electrical insulating oil has a basic nitrogen content of 2 ppm or less, a non-basic nitrogen content of 10 ppm or less, and a total sulfur content of 0.05 wt% or less.

9. A method as claimed in claim 5, wherein the oil is controlled in terms of acid numbers obtained by the test for oxidation stability prescribed by JIS C-2101 at 0.1 mg-KOH/g or less.

* * * * *